US011346179B2

(12) United States Patent
Kellner et al.

(10) Patent No.: US 11,346,179 B2
(45) Date of Patent: May 31, 2022

(54) DOWNHOLE TOOL WITH CAST BODY SECURABLE IN A TUBULAR

(71) Applicant: INNOVEX DOWNHOLE SOLUTIONS, INC., Houston, TX (US)

(72) Inventors: Justin Kellner, Adkins, TX (US); Tyler Tinnin, Cypress, TX (US); Bennett Griffith, III, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 235 days.

(21) Appl. No.: 16/517,194

(22) Filed: Jul. 19, 2019

(65) Prior Publication Data

US 2021/0017825 A1 Jan. 21, 2021

(51) Int. Cl.

| | |
|---|---|
| ***E21B 33/16*** | (2006.01) |
| ***E21B 34/10*** | (2006.01) |
| ***E21B 23/01*** | (2006.01) |
| ***E21B 34/06*** | (2006.01) |
| ***E21B 21/10*** | (2006.01) |

(52) U.S. Cl.

CPC ..... *E21B 33/16* (2013.01); *E21B 21/10* (2013.01); *E21B 23/01* (2013.01); *E21B 34/06* (2013.01); *E21B 34/10* (2013.01)

(58) Field of Classification Search

CPC ..... E21B 33/16; E21B 33/165; E21B 33/167; E21B 33/14; E21B 23/01; E21B 34/10; E21B 34/06; E21B 21/10–106; E21B 21/00

See application file for complete search history.

(56) References Cited

U.S. PATENT DOCUMENTS

| | | | | |
|---|---|---|---|---|
| 5,472,053 | A * | 12/1995 | Sullaway | E21B 34/06 166/327 |
| 2014/0216742 | A1* | 8/2014 | Darbe | E21B 21/10 166/285 |
| 2017/0292338 | A1* | 10/2017 | Downey | E21B 21/10 |

OTHER PUBLICATIONS

Baker-Hughes, Float Equipment Insert for Product Family No. H26668; Product Family No. H26656; Product Family No. H26664; Product Family No. H26659; Product Family No. H26662; and Product Family No. H26660, p. 81.

* cited by examiner

*Primary Examiner* — George S Gray
(74) *Attorney, Agent, or Firm* — MH2 Technology Law Group LLP

(57) ABSTRACT

A downhole tool includes a generally-cylindrical body at least partially made of a cast material, a valve positioned within the body, a first fin positioned on the body and extending outwards therefrom, and a second fin positioned on the body and extending outwards therefrom. The first and second fins are configured to engage an inside diameter surface of an oilfield tubular and retain a bonding material in an annular region defined radially between the body and the inside diameter surface of the oilfield tubular, and axially between the first and second fins.

22 Claims, 7 Drawing Sheets

DOWNHOLE TOOL WITH CAST BODY SECURABLE IN A TUBULAR

BACKGROUND

In the oil and gas industry, a variety of tools have been developed to be run into a wellbore and support various operations. These are often referred to as "downhole tools." Float equipment is one type of downhole tool, and generally is used to support completion operations. For example, a float shoe may be secured to a lower end of a casing string to provide a check valve function that prevents fluid in the wellbore from entering the interior of the casing as the casing proceeds into the wellbore. Float shoes may also be used to prevent reverse flow ("U-tubing") of cement slurry back into the casing during cementing operations. Similarly, float collars may also include check valves and may also be used to prevent such well-fluid ingress and U-tubing, e.g., in combination with float joints. Other downhole tools may include plugs, sleeves, valves, etc.

In some situations, casing strings (and/or other oilfield tubular strings) may require premium threads for connections between adjacent pipe joints. Premium threads may have small tolerances, special shapes, or both, and thus may require expensive and time-consuming thread-forming operations. Thus, to couple the float equipment (or other types of downhole tools) to the strings that include premium threads, the tools also typically require premium threads, increasing the cost and potentially extending the delivery time of the float equipment. This situation may be further complicated when different casing sizes, different weights, etc. are used, which can result in a need to store or make many differently-sized tools to support completion operations for a single well, let alone many wells.

SUMMARY

Embodiments of the disclosure may provide a downhole tool that includes a generally-cylindrical body at least partially made of a cast material, a valve positioned within the body, a first fin positioned on the body and extending outwards therefrom, and a second fin positioned on the body and extending outwards therefrom. The first and second fins are configured to engage an inside diameter surface of an oilfield tubular and retain a bonding material in an annular region defined radially between the body and the inside diameter surface of the oilfield tubular, and axially between the first and second fins.

Embodiments of the disclosure may also provide a method that includes positioning a valve in a mold, filling the mold with cement around the valve, such that a cement body is formed around the valve, releasing the mold from the cement body, and fixing a first fin and a second fin to the cement body, wherein the first and second fins are spaced axially apart and extend radially outwards from the cement body.

Embodiments of the disclosure may further provide a downhole tool including an oilfield tubular, a generally-cylindrical body formed at least partially from cement and positioned within the oilfield tubular, a valve positioned in the body, a first fin coupled to the body and extending radially outward therefrom and into engagement with the oilfield tubular, a second fin coupled to the body and extending radially outward therefrom and into engagement with the oilfield tubular, such that an annular region is defined radially between the body and the oilfield tubular and axially between the first and second fins, and a bonding material in the annular region, the bonding material being configured to bond the body to the oilfield tubular.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
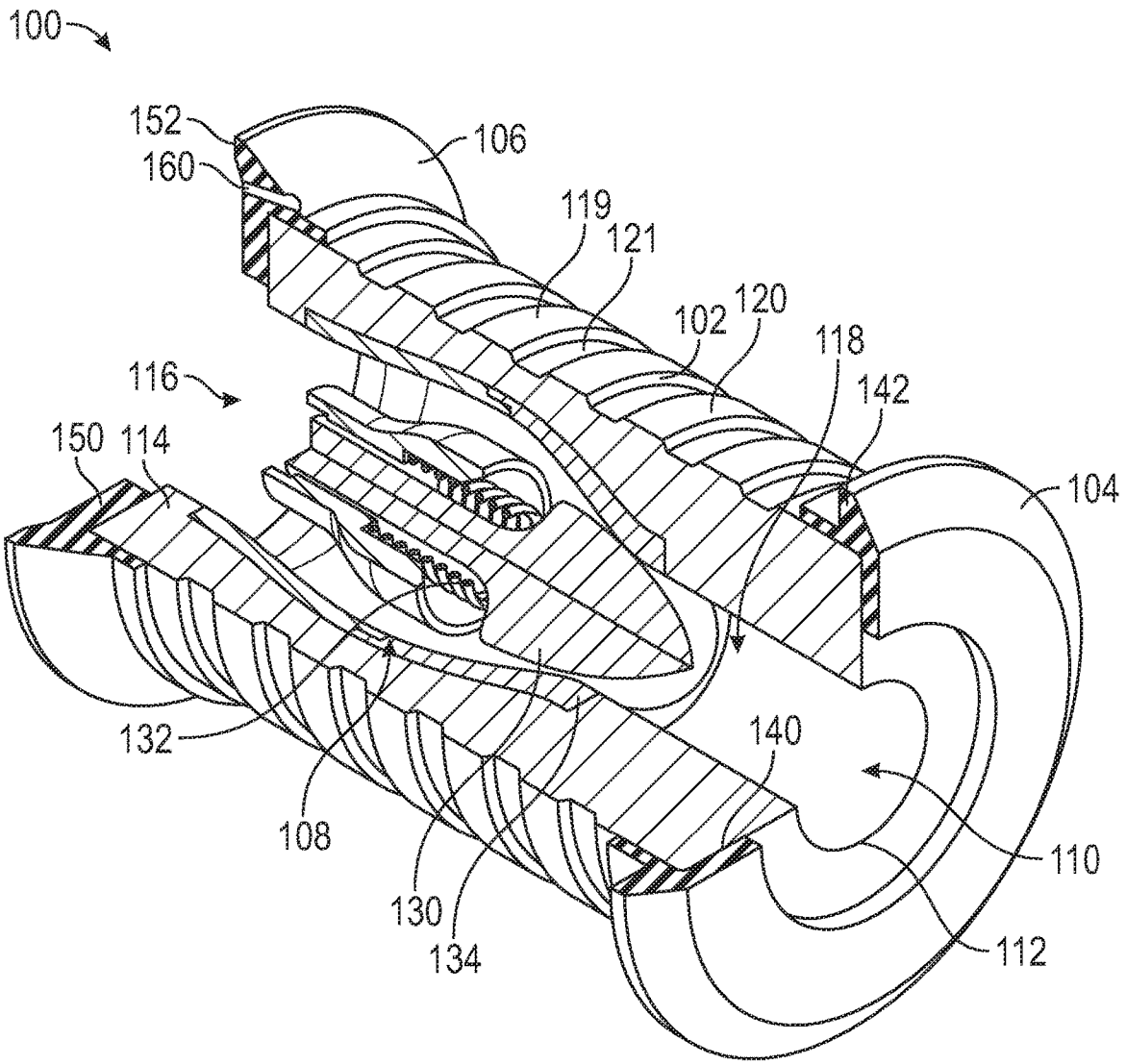
FIG. 1 illustrates a perspective, quarter-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective, quarter-sectional view of a downhole tool 100, according to an embodiment. The downhole tool 100 may include a generally-cylindrical body 102, a first fin 104, a second fin 106, and, in the specific, illustrated embodiment, a float valve assembly 108. While the illustrated downhole tool 100 is discussed and described herein generally in the context of a float valve (e.g., a float shoe or float collar) having such a float valve assembly 108, it will be appreciated that the downhole tool 100 could be a latch valve, any other type of valve, a frac sleeve, or any other type of tool configured to be run into a wellbore as part of a string of tubulars (e.g., casing, drill pipe, etc.), and as such, may include different types of equipment.

The body 102 may be formed at least partially from cement, epoxy, or another solid, e.g., castable, material, as will be described in greater detail below. The body 102 may thus be referred to herein as a "cement body," with it being appreciated that this connotes at least partial (e.g., about half, a majority, or an entire) formation by cement. The cement used for the body 102 may be any formulation suitable for the intended use, including any suitable hardeners and/or reinforcement (e.g., fibers, steel), etc. The body 102 may also define a bore 110, which may extend axially therein, e.g., entirely between a first axial end 112 of the body 102 and a second axial end 114 thereof. In some embodiments, the bore 102 may include a radially larger portion 116, in which the float valve assembly 108 is positioned, and a radially smaller portion 118 extending from the larger portion 116 and allowing fluid communication with the float valve assembly 108.

An outer diameter surface 119 may extend axially between the first and second axial ends 112, 114 of the body 102, with the body 102 being defined radially between the outer diameter surface 119 and the bore 110. Further, ridges 120 and grooves 121 may be defined in the outer diameter surface 119. For example, the ridges 120 may extend radially outwards with respect to the grooves 121, which may be situated between axially-adjacent ridges 120. Further, the ridges 120 and grooves 121 may extend circumferentially, as shown, entirely around the body 102, but in other embodiments may extend partially around the body 102 and/or in other directions (e.g., partially axially, zig-zag, etc.).

In some embodiments, the float valve assembly 108 may include a valve element 130, a valve seat 132, and a biasing member 134. The valve element 130 may be biased by the biasing member 134 toward the valve seat 132, so as to obstruct (e.g., prevent) fluid flow axially through the bore 102, e.g., from the second axial end 114 to the first axial end 112, while allowing fluid flow axially through the bore 102 from the first axial end 112 to the second axial end 114. Again, it is emphasized that different embodiments may include different valves, valve assemblies, sleeves, or other equipment positioned in the body 102, depending on the intended use of the downhole tool 100.

The first and second fins 104, 106 may be secured to the body 102 and may extend radially outwards therefrom. The first and second fins 104, 106 may be axially offset from one another, e.g., positioned proximal to the opposite axial ends 112, 114 of the body 102. The first and second fins 104, 106 may be made from a polymer, elastomer, or another material suitable for engaging and sealing with a surrounding tubular. For example, the first and second fins 104, 106 may be made at least partially from rubber or urethane.

Further, the first and second fins 104, 106 may be bonded to the body 102, e.g., using a bonding material such as epoxy. The first fin 104 may include an L-shaped connecting portion 140, and a tapered portion 142 extending outward therefrom. The L-shaped connection portion 140 may be bonded to the first axial end 112 and to the outer diameter surface 119. The tapered portion 142 may be oriented to extend toward the second end 114, which may facilitate sliding the tool 100 into a surrounding tubular, with the first end 112 preceding the second end 114. Further, the tapered portion 142 may be configured to deflect so as to increase or decrease its radial outer-most extent, e.g., depending on the size of the tubular into which it is received, as will be described in greater detail below. It will be appreciated that the body 102 and fins 104, 106 may be configured to slide into a surrounding tubular in either direction.

The second fin 106 may similarly include an L-shaped connection portion 150 and a tapered portion 152. The L-shaped connection portion 150 may be configured to be bonded to the second end 114 and the outer diameter surface 119 of the body 102. The tapered portion 152 may extend away from the second end 114, away from the body 102, so as to support sliding the tool 100 into the surrounding tubular with the first end 112 preceding the second end 114. The tapered portion 152 may be configured to deflect to engage surrounding tubulars of a range of different inner diameters.

The second fin 106 may also optionally include an injection port 160. In some embodiments, the first fin 104 may instead or additionally include the injection port 160 or another injection port, e.g., in addition to the injection port 160. In the illustrated embodiment, the injection port 160 extends through the second fin 106, at least partially in the axial direction.

Figure 2A:
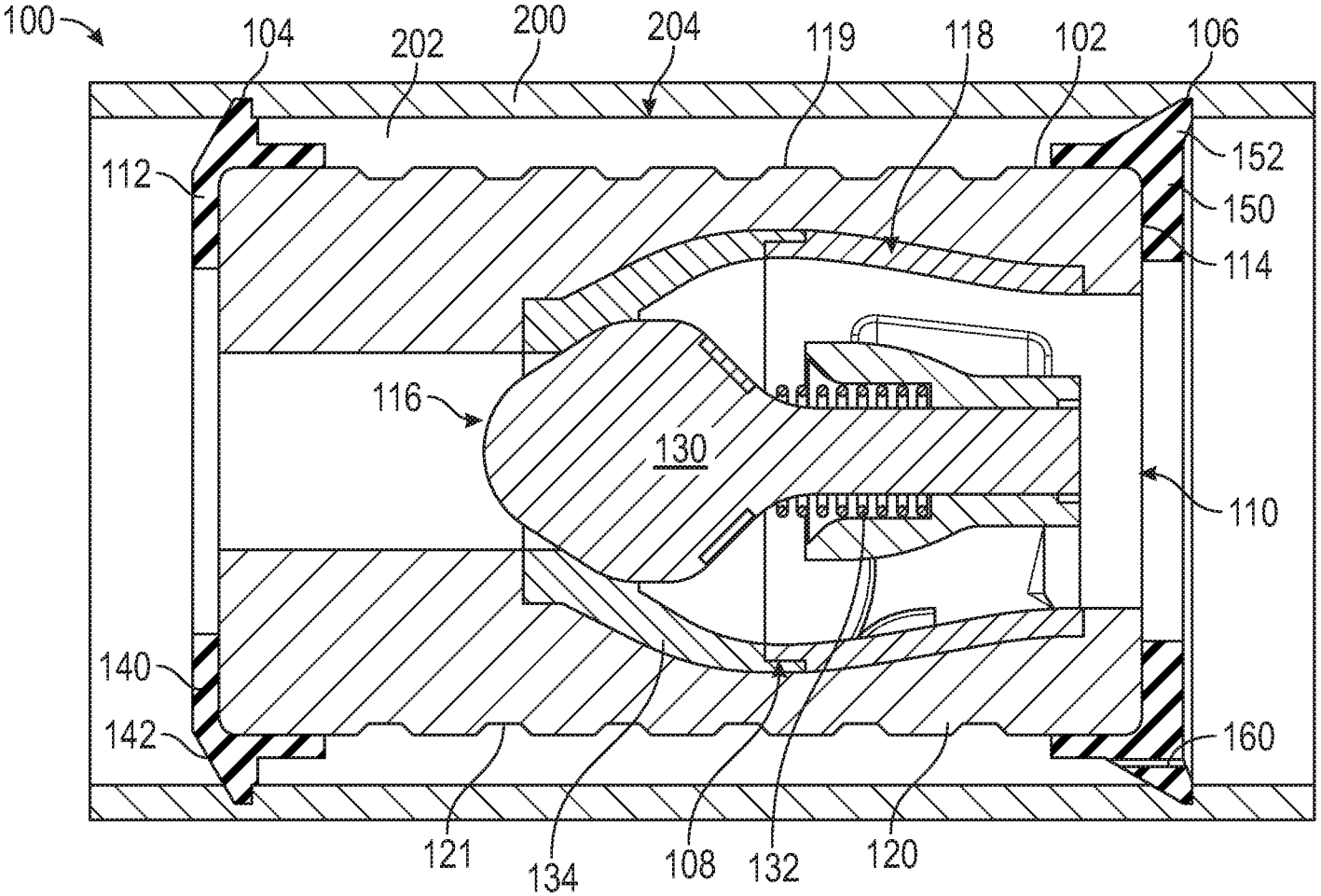
FIG. 2A illustrates a side, cross-sectional view of the downhole tool, according to an embodiment.

FIG. 2A illustrates a side, cross-sectional view of the downhole tool 100, according to an embodiment. In this embodiment, the body 102, fins 104, 106, and the float valve assembly 108 are positioned within a surrounding tubular 200. As shown, the fins 104, 106 engage an inner diameter surface 202 of the surrounding tubular 200. An annular region 204 may thus be defined radially between the outer diameter surface 119 of the body 102 and the inner diameter surface 202 of the surrounding tubular 200, and axially between the fins 104, 106.

Figure 2B:
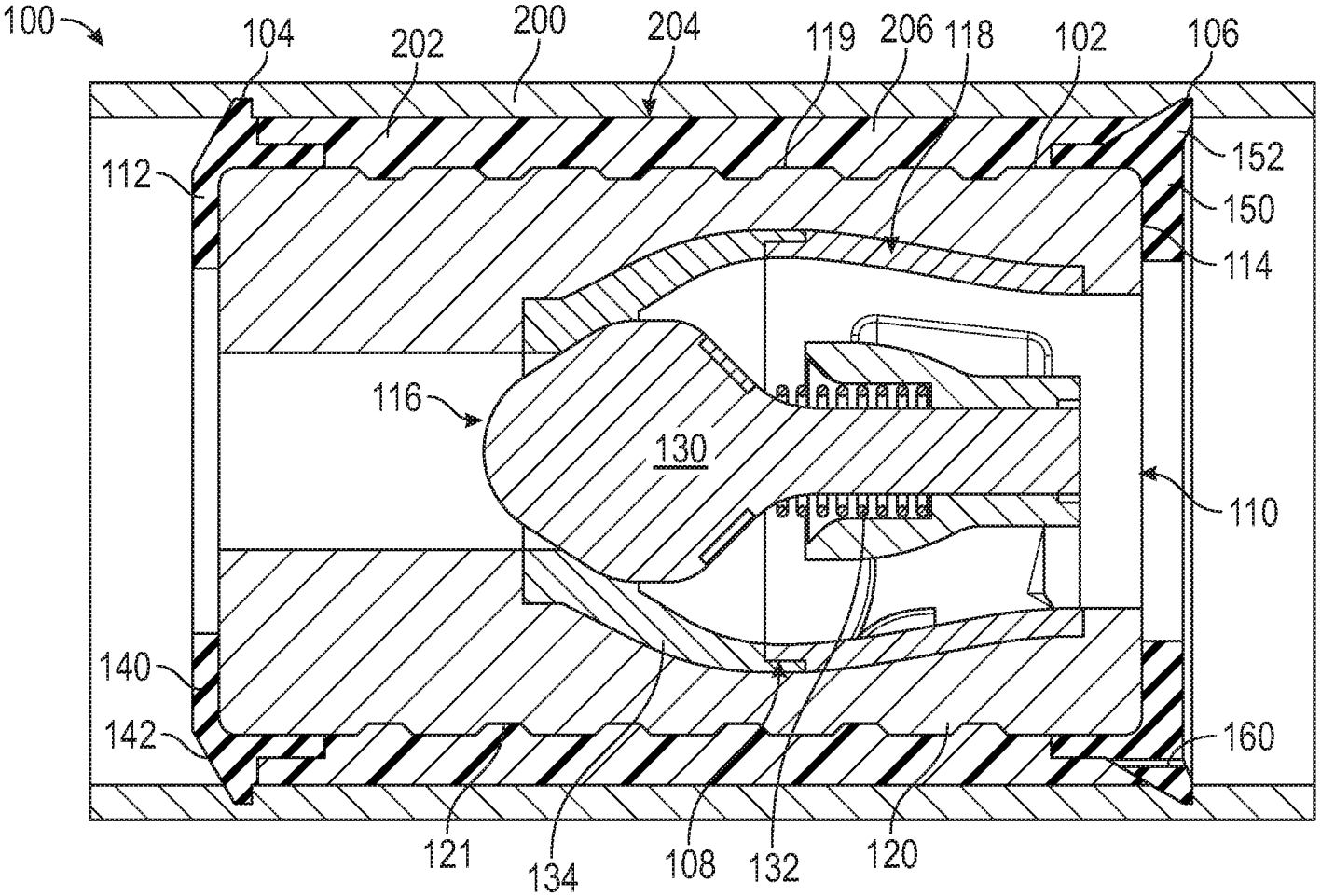
FIG. 2B illustrates a side, cross-sectional view of the downhole tool including a bonding material that bonds a body of the downhole tool to a surrounding tubular, according to an embodiment.

As mentioned above, the injection port 160 extends through the first fin 104, in this embodiment, and thus communicates with the annular region 204. Accordingly, a bonding material 206 may be introduced through the injection port 160 and into the annular region 204. The bonding material 206 may be an epoxy. FIG. 2B illustrates the downhole tool 100 with the bonding material 206 substantially or entirely filling the annular region 204. When cured, the bonding material 206 may hold the body 102 in place within the surrounding tubular 200.

In an embodiment including the ridges 120 and grooves 121, as shown, the ridges 120 and grooves 121 may provide axially-facing surfaces that engage the bonding material 206, thereby increasing the holding capability of the bonding material 206 against axial forces. Furthermore, as mentioned above, the tapered portions 142, 152 of the fins 104, 106 may be configured to deflect. Such deflection may serve not only to accommodate surrounding tubulars 200 of different sizes, but also to allow gas within the annular region 204 to escape while the bonding material 206 is injected and to provide an external indication when the annular region 204 is full, by allowing some of the bonding material 206 to move therepast.

In some embodiments, the injection port 160 may, initially, be omitted. In such embodiments, the injection port 160 may be formed by a puncturing member (e.g., an injection needle) that pierces through one of the fins 104, 106. Once the puncturing member pierces through the fin 104 or 106, the bonding material 206 may be fed therethrough. When the puncturing member is withdrawn, the injection port 160 may close. In addition, in some embodiments, evacuation ports may also be provided, e.g., in one or both of the fins 104, 106 to allow gas entrained within the annular region 204 to escape while the bonding material 206 is fed therein.

Figure 3:
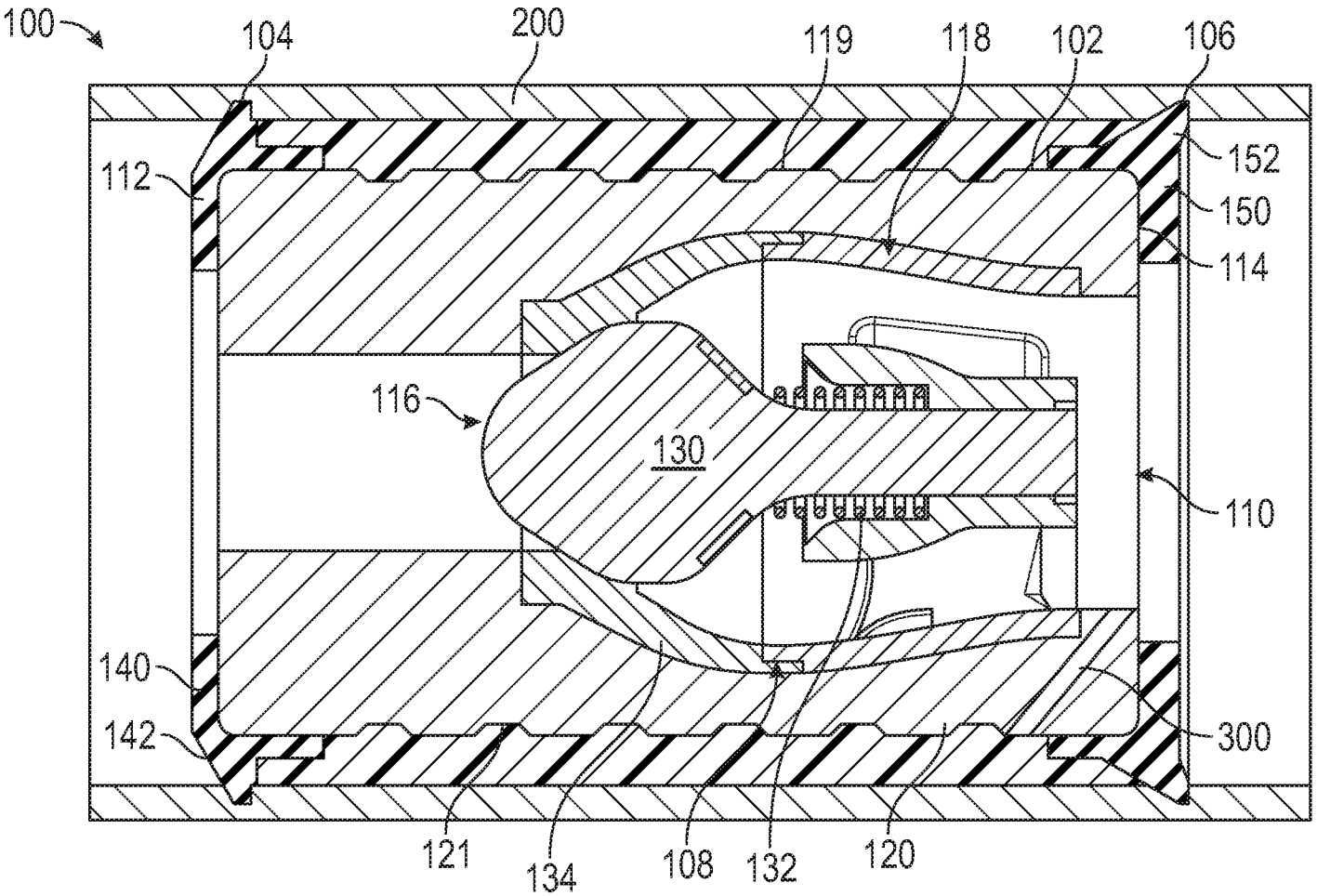
FIG. 3 illustrates a side, cross-sectional view of another embodiment of the downhole tool.

FIG. 3 illustrates another embodiment of the downhole tool 100, similar to the downhole tool 100 of FIGS. 2A and 2B, but with an injection port 300 extending through the body 102. The injection port 300 in the body 102 may serve the same function as the injection port 160 extending through the fin 104, allowing for communication with the annular region 204 and introduction of bonding material 206 thereto.

Figure 4:
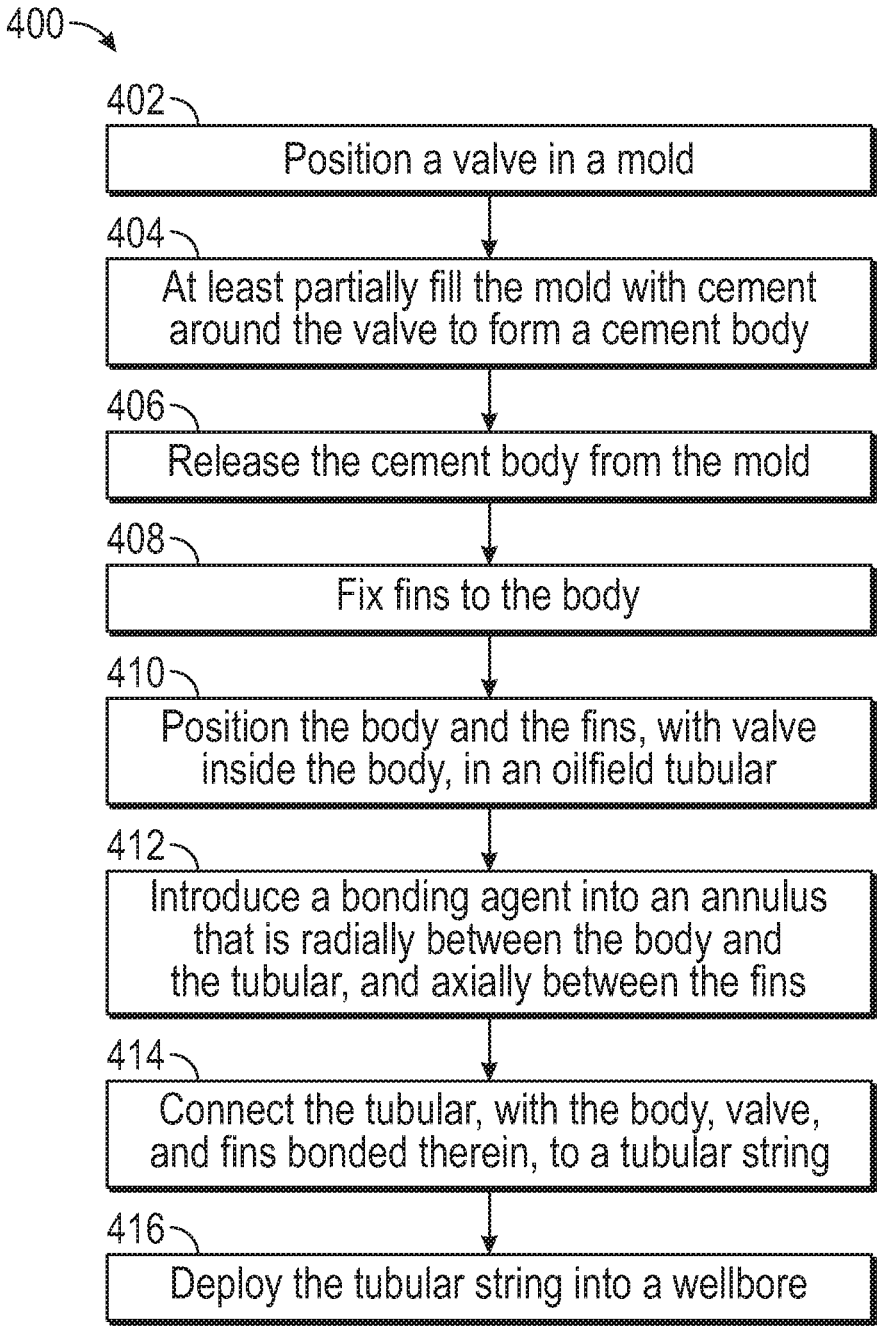
FIG. 4 illustrates a flowchart of a method for constructing a downhole tool, according to an embodiment.
Figure 5:
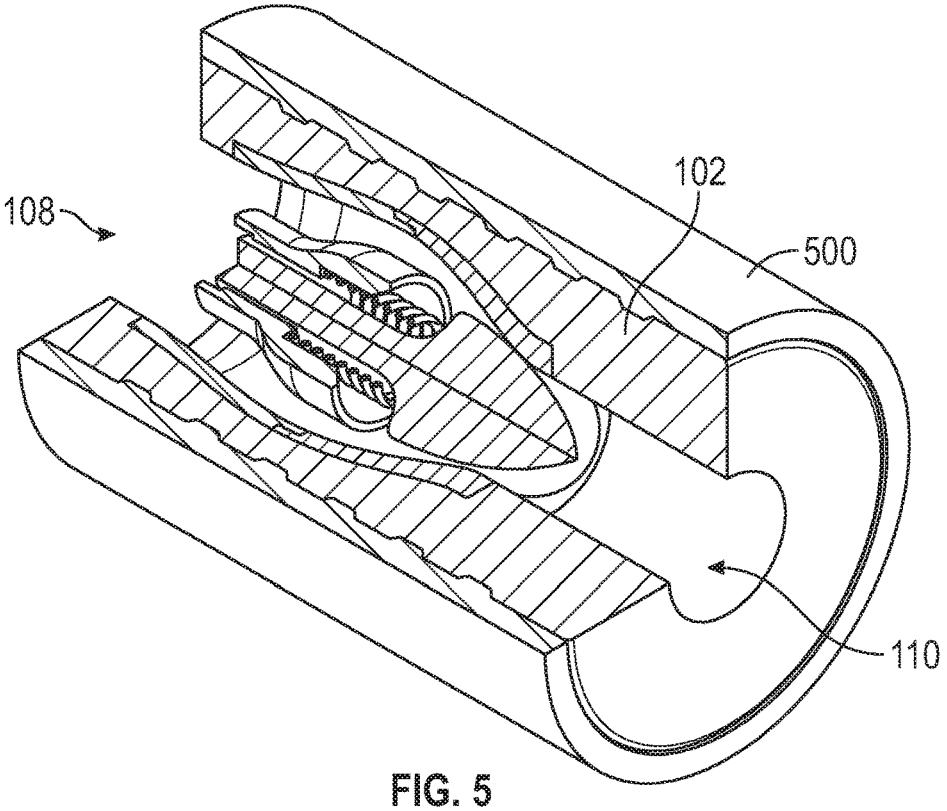
FIG. 5 illustrates a perspective view of a mold being filled with cement around a valve to form a body of the downhole tool, according to an embodiment.
Figure 6:
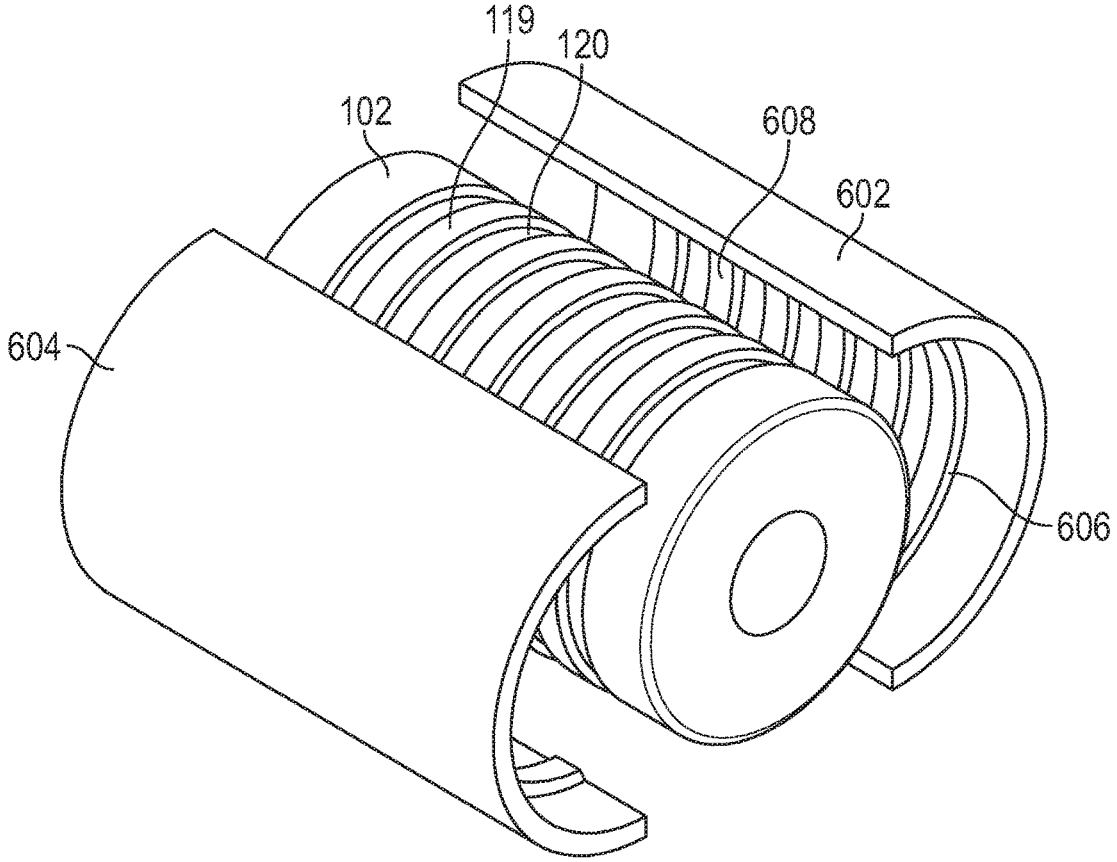
FIG. 6 illustrates a perspective view of the body releasing from the mold, according to an embodiment.
Figure 7:
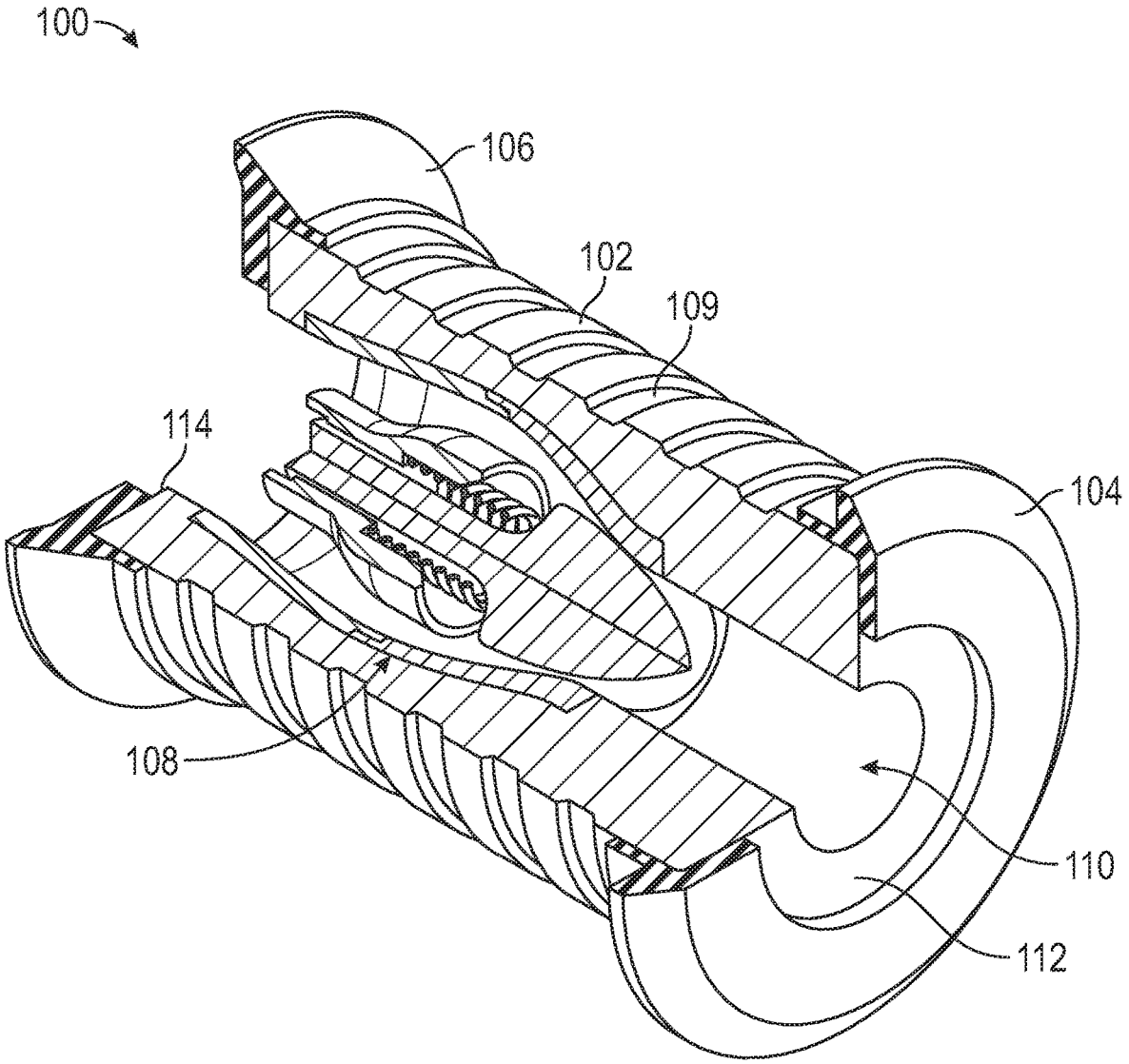
FIG. 7 illustrates a perspective view of fins being attached to the body, according to an embodiment.

FIG. 4 illustrates a flowchart of a method 400 for fabricating a downhole tool, according to an embodiment. Some of the stages of the method 400 are generally illustrated in FIGS. 5-7. The method 400 will thus be described herein with respect to the components of the downhole tool 100, with it being appreciated that this is merely an example.

Referring to FIGS. 4 and 5, the method 400 may begin, at 402, by positioning a valve (e.g., the valve assembly 108) in a mold 500. The mold 500 may then be at least partially filled with cement, around the valve 108, as at 404. This may result in the formation of the body 102, at least partially from cement. A fixture may be employed to form the bore 110 away from the valve assembly 108.

The method 400 may then proceed to releasing the body 102 from the mold 500, as at 406. As shown in FIG. 6, the mold 500 may, for example, be made from two or more segments 602, 604 may be separated to release the body 102. In other embodiments, the mold 500 may be otherwise configured to allow for release of the body 102, or may be consumable and destroyed to release the body 102. The mold 500 may define ridges 606 and grooves 608 therein, in some embodiments, which may produce a profile on the outer diameter surface 119 of the body 102, e.g., forming the ridges 120 and grooves 121 as complements to the grooves 608 and the ridges 606.

Next, and as shown in FIG. 7, the fins 104, 106 may be fixed to the body 102, as at 408. In one example, the fins 104, 106 may be bonded to the body 102, and axially offset from one another, e.g., positioned on opposite axial ends 112, 114 of the body 102. For example, the fins 104, 106 may bonded to the outer diameter surface 119 of the body 102.

The method 400 may then proceed to positioning the body 102 having the first and second fins 104, 106 fixed thereto in an inside diameter of an oilfield tubular (e.g., the tubular 200 of FIGS. 2A and 2B), as at 410. This may result in the annular region 204 being defined radially between the cement body 102 and the oilfield tubular 204 and axially between the first and second fins 104, 106. In at least one embodiment, positioning the body 102 and fins 104, 106 (e.g., and valve assembly 108 within the body 102) within the tubular 200 may proceed by sliding the body 102, with the first end 112 preceding the second end 114, into the tubular 200 (although the ordering of the first and second end 112, 114 may be reversed). During this procedure, the fins 104, 106 may deflect by engagement with the tubular 200, and form at least a partial seal therewith. The degree to which the fins 104, 106 deflect may be a function of the inside diameter of the tubular 200. As such, the body 102 and fins 104, 106 may be configured to be employed with tubulars 200 having a range of inside diameters.

The method 400 may then proceed to introducing a bonding material 206 into the annular region 204, as at 412. As explained above, this may proceed via the injection port 160 and/or 300 and/or by piercing one of the fins 104, 106 using an injection needle. Furthermore, the introduction of the bonding material 206 may continue until the annular region 204 is substantially or totally filled, which may be indicated when the bonding material 206 begins to deflect and move past one or both fins 104, 106. The bonding material 206 may then be left to cure, as at 414, thereby securing the body 102, fins 104, 106, and valve assembly 108 within the tubular 200.

The oilfield tubular 200 into which the body 102, fins 104, 106, and valve assembly 108 are received and secured may be pre-threaded, according to the specifications of the tubular string of which it will form a part. Accordingly, the method 400 may then proceed to connecting the tubular 200 to the string, as at 416, and deploying the string into a well, as at 418.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a generally-cylindrical body;

a valve positioned within the body;

a first seal positioned on the body and extending outwards therefrom; and a second seal positioned on the body and extending outwards therefrom, wherein the first and second seals are configured to engage an inside diameter surface of an oilfield tubular and retain a bonding material in an annular region defined radially between the body and the inside diameter surface of the oilfield tubular, and axially between the first and second seals, and wherein the first and second seals are each at least partially made from an elastomer.

2. The downhole tool of claim 1, wherein the first and second seals are positioned proximal to opposite axial ends of the body.

3. The downhole tool of claim 1, wherein an outer diameter surface of the body defines ridges and grooves extending radially.

4. The downhole tool of claim 1, wherein the valve comprises a float valve assembly.

5. The downhole tool of claim 1, wherein the body defines a bore extending therethrough, the valve being positioned in the bore.

6. The downhole tool of claim 1, wherein the body is at least partially made from a cast material.

7. The downhole tool of claim 6, wherein the cast material comprises cement.

8. A downhole tool comprising:

a generally-cylindrical body;

a valve positioned within the body;

a first seal positioned on the body and extending outwards therefrom; and a second seal positioned on the body and extending outwards therefrom, wherein the first and second seals are configured to engage an inside diameter surface of an oilfield tubular and retain a bonding material in an annular region defined radially between the body and the inside diameter surface of the oilfield tubular, and axially between the first and second seal, and wherein the first seal defines an injection port extending at least partially axially therethrough, and wherein the injection port is configured to receive the bonding material therethrough.

9. A downhole tool comprising:

a generally-cylindrical body;

a valve positioned within the body;

a first seal positioned on the body and extending outwards therefrom; and a second seal positioned on the body and extending outwards therefrom, wherein the first and second seals are configured to engage an inside diameter surface of an oilfield tubular and retain a bonding material in an annular region defined radially between the body and the inside diameter surface of the oilfield tubular, and axially between the first and second seal, and wherein the body defines an injection port extending therein and configured to communicate the bonding material into the annular region.

10. A downhole tool comprising:

a generally-cylindrical body;

a valve positioned within the body;

a first seal positioned on the body and extending outwards therefrom; and a second seal positioned on the body and extending outwards therefrom, wherein the first and second seals are configured to engage an inside diameter surface of an oilfield tubular and retain a bonding material in an annular region defined radially between the body and the inside diameter surface of the oilfield tubular, and axially between the first and second seal, and wherein the first seal, the second seal, or both are configured to deflect away from the inside diameter surface of the oilfield tubular when the annular region is filled with the bonding material.

11. A method, comprising:

positioning a valve in a mold;

filling the mold with cement around the valve, such that a cement body is formed around the valve;

releasing the mold from the cement body; and fixing a first seal and a second seal to the cement body, wherein the first and second seals are spaced axially apart and extend radially outwards from the cement body.

12. The method of claim 11, further comprising positioning the cement body having the first and second seals fixed thereto into an oilfield tubular, such that an annular region is defined radially between the cement body and the oilfield tubular and axially between the first and second seals.

13. The method of claim 12, further comprising injecting a bonding material into the annular region, so as to bond the cement body with the oilfield tubular.

14. The method of claim 13, wherein injecting the bonding material comprises introducing the bonding material through an injection port formed in the first seal, an injection port formed in the cement body, or both.

15. The method of claim 13, wherein injecting the bonding material comprises piercing the first seal.

16. The method of claim 13, wherein injecting the bonding material comprises injecting the bonding material until at least one of the first seal or the second seal deflects away from the oilfield tubular and allows some of the bonding material to move therepast.

17. The method of claim 13, wherein the mold comprises ridges and grooves such that the cement body has complementary ridges and grooves, and wherein injecting the bonding material comprises injecting the bonding material into engagement with the ridges and grooves.

18. A downhole tool, comprising:

an oilfield tubular;

a generally-cylindrical body formed at least partially from cement and positioned within the oilfield tubular;

a valve positioned in the body;

a first seal comprising a first fin coupled to the body and extending radially outward therefrom and into engagement with the oilfield tubular;

a second seal comprising a second fin coupled to the body and extending radially outward therefrom and into engagement with the oilfield tubular, such that an annular region is defined radially between the body and the oilfield tubular and axially between the first and second fins; and a bonding material in the annular region, the bonding material being configured to bond the body to the oilfield tubular.

19. The downhole tool of claim 18, wherein the body defines an injection port in communication with the annular region and an axial side of the body.

20. The downhole tool of claim 18, wherein at least one of the first fin or the second fin defines an injection port extending at least partially axially therethrough and into communication with the annular region.

21. The downhole tool of claim 18, wherein the first and second fins are bonded to opposite axial ends of the body.

22. A downhole tool comprising:

a generally-cylindrical body;

a valve positioned within the body;

a first seal positioned on the body and extending outwards therefrom; and a second seal positioned on the body and extending outwards therefrom, wherein the first and second seals are configured to engage an inside diameter surface of an oilfield tubular and retain a bonding material in an annular region defined radially between the body and the inside diameter surface of the oilfield tubular, and axially between the first and second seal, and wherein the first seal comprises a first fin, and wherein the second seal comprises a second fin.

* * * * *